US007722208B1

(12) United States Patent
Dupre et al.

(10) Patent No.: US 7,722,208 B1
(45) Date of Patent: May 25, 2010

(54) RECESSED LUMINAIRE TRIM ASSEMBLY

(75) Inventors: Scott Dupre, Fall River, MA (US); Kenneth Czech, North Dartmouth, MA (US)

(73) Assignee: Genlyte Thomas Group, LLC, Louisville, KY (US)

( * ) Notice: Subject to any disclaimer, the term of this patent is extended or adjusted under 35 U.S.C. 154(b) by 190 days.

(21) Appl. No.: 11/865,007

(22) Filed: Sep. 30, 2007

(51) Int. Cl.
*F21S 8/02* (2006.01)
*F21V 7/00* (2006.01)

(52) U.S. Cl. ..... 362/147; 362/364; 362/306

(58) Field of Classification Search ..... 362/147, 362/364, 368, 370, 346, 296.01, 306
See application file for complete search history.

(56) References Cited

U.S. PATENT DOCUMENTS 1,987,705 A * 1/1935 Pedersen ..... 362/364
2,465,248 A 3/1949 McCandless
2,647,202 A 7/1953 Elmer
2,716,185 A 8/1955 Burliuk et al.
2,739,226 A 3/1956 Rex
2,998,511 A 8/1961 Chan
3,213,271 A * 10/1965 Tolbert ..... 362/281
3,375,368 A 3/1968 Dorsky
3,381,123 A 4/1968 Docimo
3,518,420 A 6/1970 Kripp
3,675,007 A 7/1972 Appleton et al.
3,721,817 A 3/1973 Contratto
4,039,822 A 8/1977 Chan et al.
4,066,887 A 1/1978 Levis
4,086,480 A 4/1978 Lahm
4,177,504 A 12/1979 Henderson, Jr. et al.
4,207,607 A 6/1980 Gulliksen
4,213,171 A 7/1980 Sassmannshausen
4,229,782 A 10/1980 Ruud et al.
4,231,080 A 10/1980 Compton
4,232,361 A 11/1980 Kelsall
4,274,615 A 6/1981 Chan et al.
4,313,154 A 1/1982 Capostagno et al.
4,327,403 A 4/1982 Capostagno et al.
4,337,506 A 6/1982 Terada
4,344,111 A 8/1982 Ruud et al.
4,382,274 A 5/1983 De Backer et al.
4,386,392 A 5/1983 Reibling
4,388,675 A 6/1983 Lewin
4,408,262 A 10/1983 Kusmer
4,428,038 A 1/1984 Rakitsch et al.
4,475,147 A * 10/1984 Kristofek ..... 362/148
4,518,896 A 5/1985 Milles, Jr.
4,551,791 A 11/1985 Salansky
4,623,956 A 11/1986 Conti
4,625,267 A 11/1986 Mikalonis
4,630,895 A 12/1986 Abdala, Jr. et al.
4,635,172 A 1/1987 Steinke
4,646,212 A 2/1987 Florence
4,703,406 A 10/1987 Elliott et al.
4,704,664 A 11/1987 McNair (Continued)

*Primary Examiner*—Stephen F. Husar
*Assistant Examiner*—Peggy A. Neils

(57) ABSTRACT

An recessed luminaire trim assembly, comprises an outer trim, an inner reflector portion having a polygon shaped cross-section defined by a plurality of reflectors and a plurality of seams defined between each of the plurality of reflectors, a flange extending outwardly from a peripheral edge of the inner reflector, a spring connected to the outer trim, the spring having at least one leg engaging the inner reflector portion and tightening the plurality of seams.

19 Claims, 6 Drawing Sheets

U.S. PATENT DOCUMENTS 4,712,168 A 12/1987 Scherrer
4,729,080 A 3/1988 Fremont et al.
4,742,440 A 5/1988 Guzzini
4,760,505 A 7/1988 Cole, Jr.
4,856,103 A 8/1989 Compton
4,866,584 A 9/1989 Plewman
4,872,097 A 10/1989 Miller
4,930,054 A 5/1990 Krebs
4,943,901 A 7/1990 Baldwin et al.
4,954,935 A 9/1990 Hammond et al.
5,010,458 A 4/1991 Fraizer
5,031,084 A 7/1991 Russo et al.
5,032,959 A 7/1991 Brass
5,045,985 A 9/1991 Russo et al.
5,086,375 A 2/1992 Fabbri et al.
5,124,901 A 6/1992 Sojka et al.
5,130,914 A 7/1992 Bengochea
5,140,301 A 8/1992 Watanabe
5,146,248 A 9/1992 Duwaer et al.
5,217,299 A 6/1993 Yoshida et al.
5,236,157 A 8/1993 Reggiani
5,251,116 A 10/1993 Wijbenga et al.
5,291,381 A 3/1994 Price
5,335,151 A 8/1994 Dahlberg
5,373,431 A 12/1994 Hayman et al.
5,375,045 A 12/1994 Ruud et al.
5,379,195 A 1/1995 Epstein
5,416,683 A 5/1995 McCarthy
5,416,684 A 5/1995 Pearce
5,426,575 A 6/1995 Richards
5,434,765 A 7/1995 Kelly et al.
5,438,495 A 8/1995 Ahlen et al.
5,440,471 A 8/1995 Zadeh
5,457,617 A 10/1995 Chan et al.
5,486,989 A 1/1996 Compton
5,493,483 A 2/1996 Lake
5,526,248 A 6/1996 Endo
5,562,343 A 10/1996 Chan et al.
5,582,479 A 12/1996 Thomas et al.
5,584,575 A 12/1996 Fickel
5,658,067 A 8/1997 Engle et al.
5,662,413 A 9/1997 Akiyama
5,673,997 A 10/1997 Akiyama
5,676,448 A 10/1997 Urbaing
5,707,143 A 1/1998 Hentz
5,725,302 A 3/1998 Sirkin
5,743,627 A 4/1998 Casteel
5,758,959 A 6/1998 Sieczkowski
5,791,768 A 8/1998 Splane, Jr.
5,800,050 A 9/1998 Leadford
5,813,744 A 9/1998 Altebarmakian
5,816,694 A 10/1998 Ideker et al.
5,826,970 A 10/1998 Keller et al.
5,836,678 A 11/1998 Wright et al.
5,851,061 A 12/1998 Hegarty
5,857,766 A 1/1999 Sieczkowski
D412,040 S 7/1999 Hudak et al.
5,957,573 A 9/1999 Wedekind et al.
5,967,363 A 10/1999 Allen
5,977,694 A 11/1999 McGuire
6,000,818 A 12/1999 Caluori
6,004,011 A 12/1999 Sieczkowski
6,019,477 A 2/2000 Wegrzyn et al.
6,027,231 A 2/2000 Fouke
6,033,093 A 3/2000 Latsis et al.
6,036,338 A 3/2000 Gordin
6,042,251 A 3/2000 McCarthy et al.
6,045,232 A 4/2000 Buckmaster
6,050,708 A 4/2000 Roorda
D425,221 S 5/2000 Burns
6,062,704 A 5/2000 Holder
6,082,031 A 7/2000 Heaton et al.
6,095,669 A 8/2000 Cho
6,095,671 A 8/2000 Hutain
6,116,749 A 9/2000 Quiogue et al.
RE36,908 E 10/2000 Ling
6,126,300 A 10/2000 Lee
6,164,802 A 12/2000 Gromotka
D437,077 S 1/2001 Minissi et al.
6,168,294 B1 1/2001 Erni et al.
6,170,967 B1 1/2001 Usher et al.
6,174,069 B1 1/2001 Plunk et al.
6,217,197 B1 4/2001 Siminovitch et al.
6,250,776 B1 6/2001 Burkitt et al.
6,283,430 B1 9/2001 Schubert et al.
6,350,047 B1 2/2002 Ng et al.
6,364,152 B1 4/2002 Poslinski et al.
6,371,630 B1 4/2002 Unger
6,425,680 B1 7/2002 Rippel et al.
6,447,145 B1 9/2002 Thomas et al.
6,478,453 B2 11/2002 Lammers et al.
6,478,454 B1 11/2002 Jaffari et al.
6,554,457 B1 4/2003 Platt
6,561,670 B1 5/2003 Jongewaard et al.
6,585,389 B2 * 7/2003 Bonazzi ..... 362/147
6,619,821 B1 9/2003 Waycaster
6,632,006 B1 10/2003 Rippel et al.
6,655,813 B1 12/2003 Ng
6,723,588 B2 4/2004 Kim
6,969,181 B1 11/2005 Bailey et al.
7,273,301 B2 * 9/2007 Mier-Langner et al. ..... 362/364
7,374,308 B2 * 5/2008 Sevack et al. ..... 362/147
2005/0227536 A1 10/2005 Gamache et al.

* cited by examiner

RECESSED LUMINAIRE TRIM ASSEMBLY

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention pertains to recessed light fixtures. More particularly, the present invention pertains to a recessed luminaire trim assembly which utilizes a biasing spring to minimize seams between reflector surfaces.

2. Description of the Related Art

Recessed lighting fixtures have become extremely popular for both residential and commercial uses. Most recessed downlights have a trim or reflector with is generally circular cross-sectional shape. Additionally, the trim or reflector may also have a flange which extends radially from a lower peripheral edge of the reflector. The flange and reflectors have typically had circular cross-sectional shapes, in part, because the circular cross section may be formed integrally of a single piece of material without seams.

Architects desire to utilize alternative shapes for the reflectors and the flanges to match the recessed lighting fixtures to the architecture of the buildings being designed. However, when polygonal shapes are utilized for reflectors and flange designs, multiple seams are formed where the reflector elements meet one another and where the flange elements meet one another. When these seams are not tight, there is an aesthetically unpleasant appearance and hindrance of optical performance of the luminaire. This has been a primary problem with implementation of these polygonal shapes in recessed lighting.

It is preferable to minimize the width of seams between reflector surfaces and flanges so as to allow an aesthetically pleasing use of polygonal cross-sections with the reflectors and flanges.

SUMMARY OF THE INVENTION

An recessed luminaire trim assembly, comprises an outer trim, an inner reflector portion having a polygon shaped cross-section defined by a plurality of reflectors and a plurality of seams defined between each of the plurality of reflectors, a flange extending outwardly from a peripheral edge of the inner reflector, a spring connected to the outer trim, the spring having at least one leg engaging the inner reflector portion and tightening the plurality of seams. The inner trim has a generally square shaped cross-section. The spring comprises a first leg and a second leg for engaging the plurality of reflectors defining the plurality of seams. The spring is located at each of the plurality of seams. The inner reflector portion having four reflectors. The spring has a first portion and a second portion, each of the first and second portion having a leg. The spring closing the each of the seams at each of the corner of the flange. The leg extending inwardly from the spring and closing seams at the reflectors and the flanges. The trim assembly further comprises a biscuit connecting each of the seam at each corner of the flange. The outer trim further comprises a plurality of sidewalls. The spring engages two sidewalls.

A trim assembly, comprises an outer trim having a plurality of sidewalls defining a lower opening and an upper opening, a miter spring disposed at each sidewall of the lower opening, at least one leg extending inwardly from each of the spring, a plurality of reflectors positioned within the outer trim, wherein each of the plurality of reflectors is engaged by the at least one leg of the miter spring. The miter spring receives the outer trim. The at least one leg is a first leg and a second leg. The miter spring places a force on the plurality of reflectors to close seams disposed between the plurality of reflectors. The trim assembly further comprises a flange extending from each of the plurality of reflectors. The trim assembly further comprises a biscuit positioned between the flanges. The miter spring provides a force on the flanges and closing seams between the flanges. The trim assembly further comprises a fastener connecting the plurality of reflectors and the outer trim. The trim assembly further comprises an inner trim. The inner trim has a polygon shaped cross-section. The inner trim has a square shaped cross-section.

A trim assembly comprises a trim spring having at least one leg, a plurality of reflectors defining an opening, a seam located between each of the plurality of reflectors, the trim spring connected to a first stationary portion of the trim assembly, a leg of the trim spring engaging a reflector surface of the plurality of reflectors, wherein the seam is minimized due to the force of the leg on the reflector surface.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
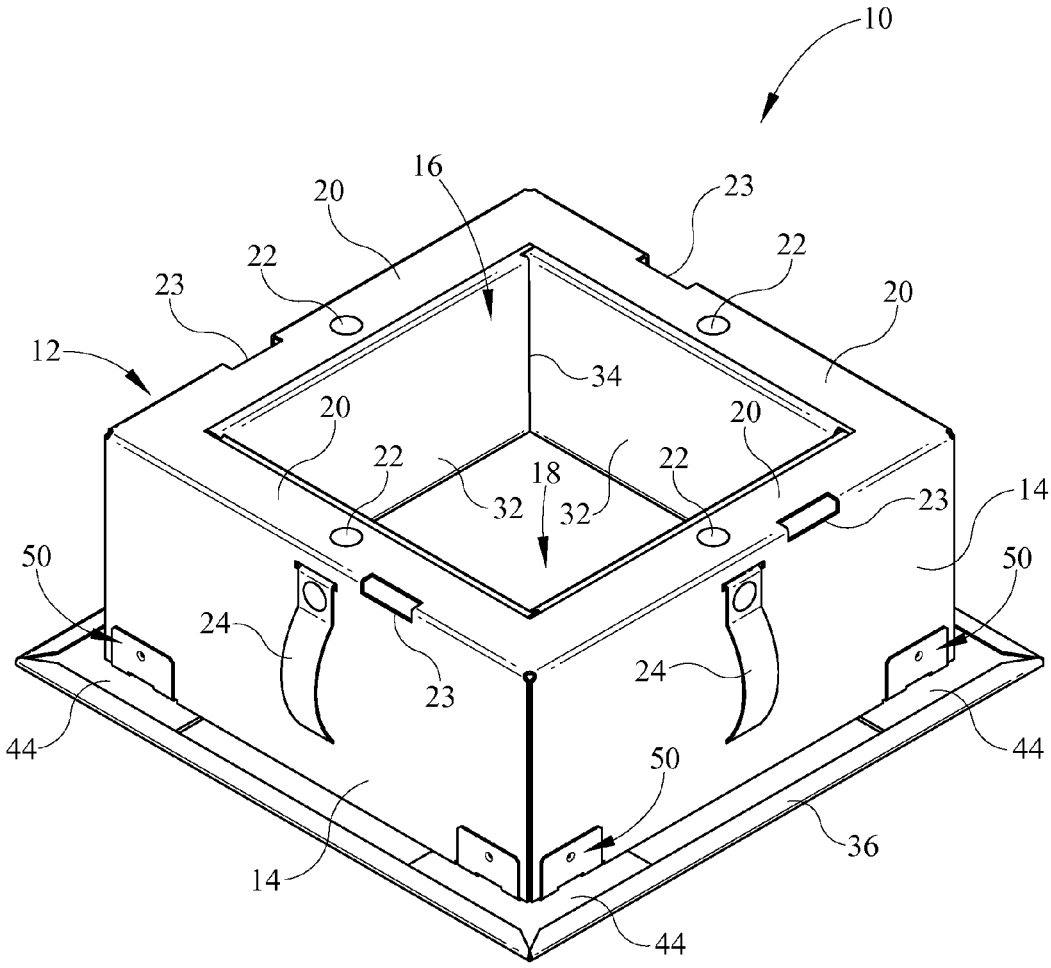
FIG. 1 is a perspective view of a recessed luminaire trim assembly.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted,"

and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Referring now in detail to the drawings, wherein like numerals indicate like elements throughout the several views, there are shown in FIGS. 1-6 various aspects of a recessed luminaire trim assembly. The trim assembly provides a plurality of reflectors forming a polygonal shape with miter springs which minimize seams between reflective surfaces and flanges. The combination of the reflectors and springs allow for an aesthetically pleasing polygon trim shape while minimizing the seam effects associated with reflector and flange seams.

Figure 2:
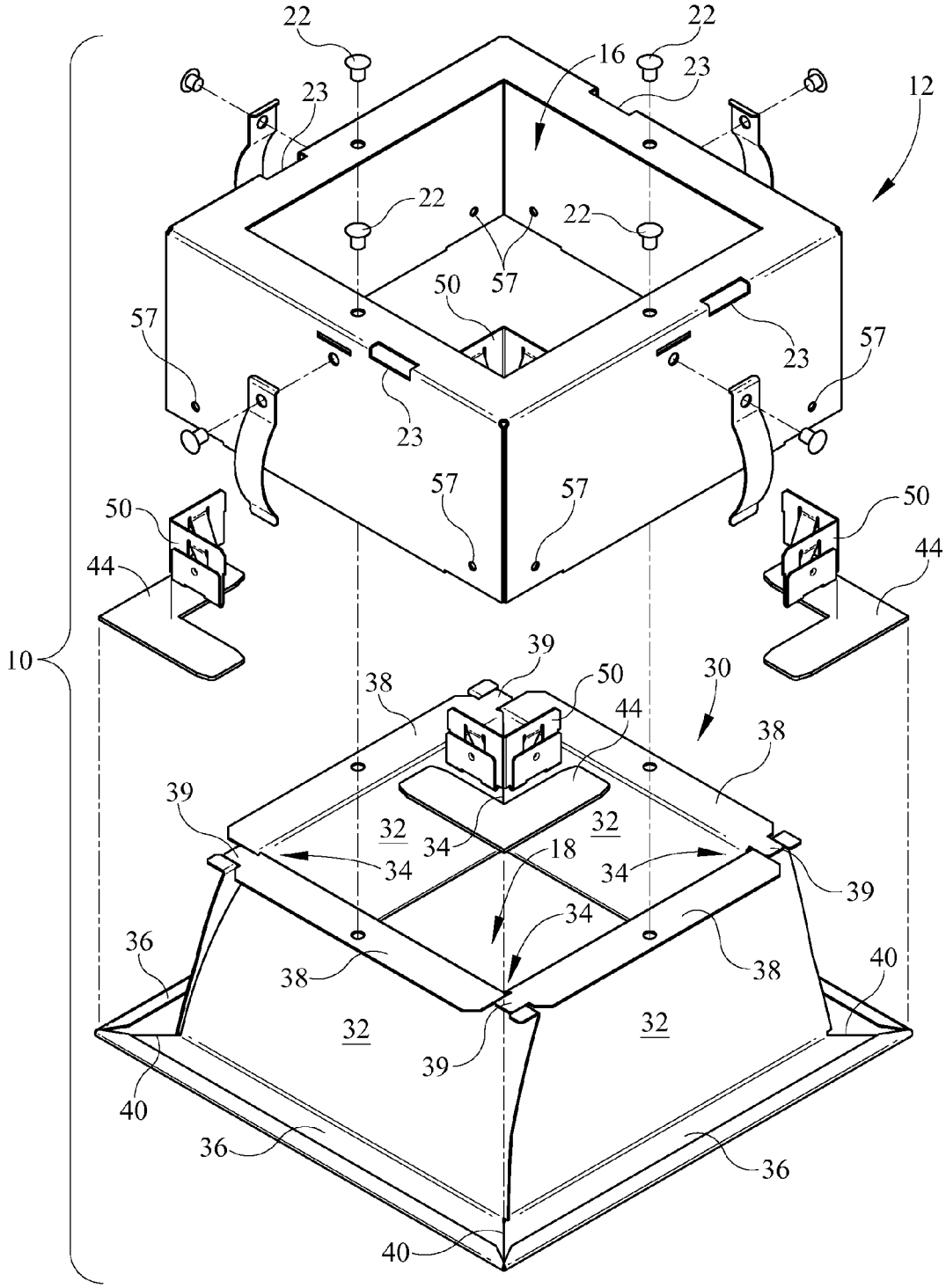
FIG. 2 is an exploded perspective view of trim assembly of FIG. 1.

Referring initially to FIG. 1, a perspective view of the polygon trim assembly 10 is depicted. In the present disclosure, the polygon is referred to as a square, however alternative shapes may be utilized as will be understood and explained further herein. Therefore the term square trim should be considered exemplary and not limiting. The square trim assembly 10 fits within a recessed lighting fixture and provides the appearance of a square fixture trim rather than the typical circular trim utilized in many recessed down lights. The square trim assembly 10 comprises an outer trim 12 and an inner trim 30 (FIG. 2). The outer trim 12 is defined by a plurality of outer trim sidewalls 14. The outer trim 12 is generally box like in shape with an upper opening 16 and a lower opening 18. The upper opening 16 allows light from a lamp or source (not shown) disposed within a fixture assembly to pass from the upper portion of the fixture through the trim assembly 10 to the room or space beneath the recessed fixture in order to provide illumination. The sidewalls 14 are substantially rectangular in shape wherein each sidewall 14 comprises upper and lower parallel edges with vertically extending side parallel edges between the upper and lower edges. The vertical edges are shorter than the upper and lower parallel edges. Thus, each sidewall 14 comprises a rectangular shape although alternative shapes may be utilized. Along the upper edges of the sidewalls 14 are outer trim upper walls 20. Each of the upper walls 20 bends and extends inwardly horizontally from the upper edges of the outer trim sidewalls 14. The upper opening 16 is partially defined by the innermost edge of each trim upper wall 20. Located within each upper wall 20 are fasteners 22 which are utilized to connect the outer trim 12 to the reflectors 32 described further herein. The fastener 22 may be various constructs including a rivet, screw, nail or other known device which attaches two parts. Each of the outer trim upper walls 20 has a longitudinal length which is substantially equal in order to define the exemplary square shaped box of the trim assembly 10. Alternatively however, the outer trim 12 need not be a square box in shape but could alternatively be rectangular or other polygonal shapes which may require the use of reflectors with seams to connect the various sides of the polygonal shape, as will be understood further herein. Extending from the sidewalls 14 are leaf springs 24 which are fastened to the sidewall 14 and are utilized to engage a housing or enclosure of the recessed fixture.

The trim assembly 10 further comprises an inner trim 30 which is positioned within the outer trim 12. The inner trim 30 comprises a plurality of reflectors or reflective surfaces 32. The reflective surfaces 32 are shown located within the outer trim 12. Within the outer trim 12, the reflector surfaces 32 extend at an angle inwardly beyond the outer edge of the upper opening 16. The inset reflectors 32 design insures that the user, when looking upwardly through the square trim assembly 10, will not see the edge of the outer trim 12 but instead will only see the reflective surfaces 32. Accordingly, the outer trim 12 may have a plurality of finishes including black or other painted color and need not be a reflective surface which, in general, may be more expensive to manufacture. Additionally, a lens may be positioned over the opening 16 if desired. The outer trim 12 comprises a plurality of apertures 23 along the upper wall 20. The apertures 23 may receive a clip for retaining a lens over the aperture 16.

Between each of the reflective surfaces 32 is a seam 34. Due to the shape of the square trim assembly 10, the plurality of seams 34 are created by the reflective surfaces 32 at various corner locations in order to provide the polygonal shape. It is highly desirable to minimize the effects or visibility of these seams 34 by forcing the edges of each reflective surface 32 to engage one another thereby minimizing the seam width 34. The reflectors 32 have a lower flange 36 extending from the lower edges of the reflectors 32 which extend outwardly to hide the outer trim 12 from viewing. Accordingly, when installed, the exemplary flange 36 abuts a ceiling lower surface and appears as a square shape to a user below. As previously indicated, alternative polygonal shapes may be utilized.

Figure 4:
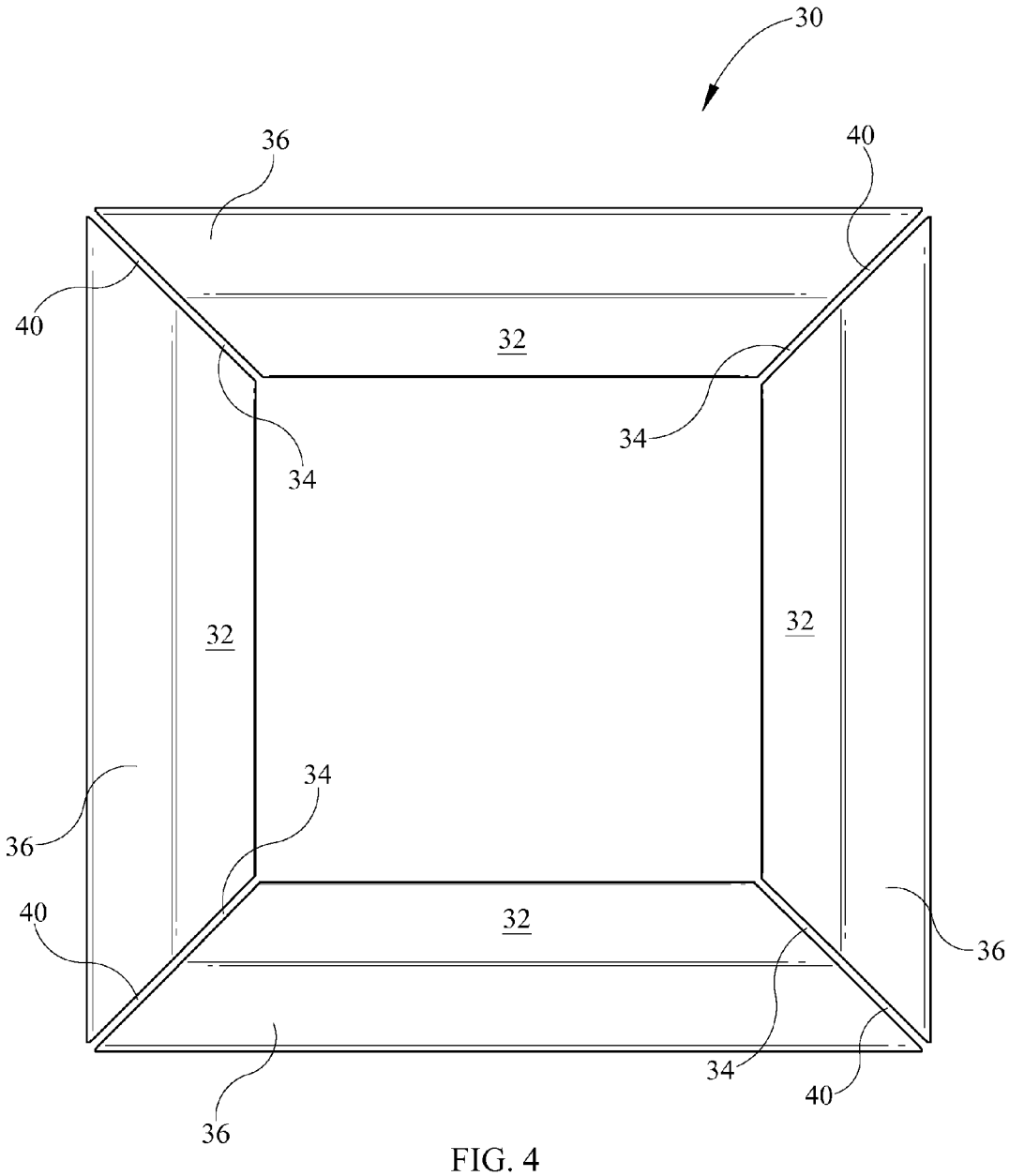
FIG. 4 is a bottom view of the inner trim of the trim assembly of FIG. 1.

Referring now to FIG. 2, an exploded perspective view of the square trim assembly 10 is depicted. In the exemplary embodiment, the outer trim 12 is exploded from the inner trim 30. A plurality of reflectors 32, an upper flange 38 and a lower flange 36 define the inner trim 30. The reflectors 32 each engage one another defining seams 34. When the engagement between reflectors 32 is not tight, the seams 34 widen. Such widening is not aesthetically pleasing and may alter the optical performance of the fixture. The reflectors 32 have an upper flange 38 and a lower flange 36. Each upper flange 38 comprises a tab 39 which engages an adjacent reflector upper flange 38 to retain the upper portions of the reflectors 32 together during construction. The tabs 39 are folded downwardly, from the position depicted, so as to be about 90 degrees to the upper surface of the upper flanges 38. The upper flanges 38 define a substantially square shaped opening corresponding to the opening 16 so that the opening of inner trim 30 is substantially aligned with the upper opening of the outer trim 12. Extending from the lower edges of the reflectors 32 is a lower flange 36. Since the lower flanges 36 extend from the lower edges of the reflectors 32, seams 40 are also formed on the lowermost surface of the flanges 36 at each corner of the trim assembly 10 at an angle of about forty-five (45) degrees. The seams 40 extend from the seams 34 as best shown in FIG. 4. It is also desirable therefore to minimize the seam widths 40 within each of these corners to therefore improve aesthetic appearance of the trim assembly 10 when seen from a room beneath the fixture and trim assembly 10.

Figure 3:
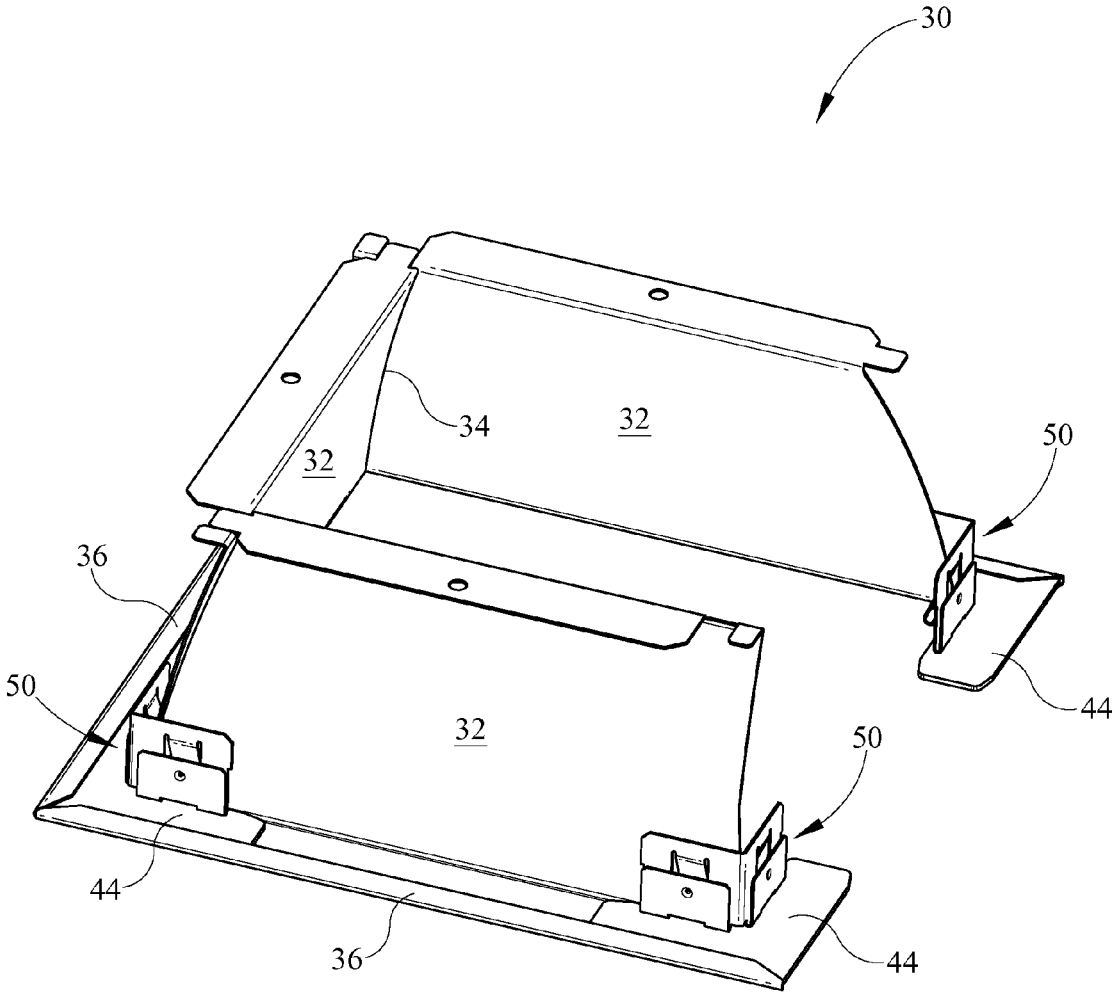
FIG. 3 is a perspective view of the inner trim of the trim assembly of FIG. 1.

Referring now to FIG. 3, one of the reflectors 32 is removed to show the curved cross-section of the remaining reflectors 32. Although the upper opening 16 is defined by a square shape and the lower opening 18 of the inner trim 30 is defined by a square shape, the cross-sections of the reflectors 32 are curved to provide better light control from the reflectors 32. The reflectors 32 are curved in a concave form when viewed from an interior position of the assembly 10 providing desirable optical performance. The side edges of the reflectors 32 are angled in moving from a smaller upper dimension in the longitudinal direction of the upper flange 38 to a larger dimension in the longitudinal direction of the lower flange 36.

Nonetheless, a cross-sectional view of the exemplary inner trim 30 depicts a square cross-section.

Also depicted within FIG. 3 are a plurality of biscuits 44. Each flange 36 receives a biscuit 44 at ends of the flange 36. The biscuits 44 are substantially L-shaped wherein each leg of the biscuit 44 engages one of the reflectors 32. Specifically, the peripheral edges of the lower flange 36 are rolled, turned or formed with a space wherein the biscuits 44 may be received. Thus, the flanges 36 are frictionally connected and vertical movement, that is movement between horizontal planes, of one flange 36 relative to an adjacent flange 36 is inhibited. In FIG. 3, since one of the reflectors 32 is removed, two adjacent biscuits are extending outwardly within the open area wherein the removed reflector 32 should be located. The biscuits 44 provide at least one function in that they maintain each flange 36 at the same elevation so that one flange is not displaced upwardly or downwardly from an adjacent flange 36, which would be aesthetically unpleasant.

Referring now to FIG. 4, a bottom view of the inner trim 30 is depicted. As shown from below, the figure depicts the various seams 34, 40 of the reflectors 32 and flange 36. When the inner trim 30 is manufactured, the seams 34 are generally wide due to the movement of the reflector material to a neutral position. However, such seams 34, 40 are aesthetically unpleasing when illuminated. From the position depicted, the inner trim 30 requires an external force to close or minimize the seams 34,40.

Figure 5:
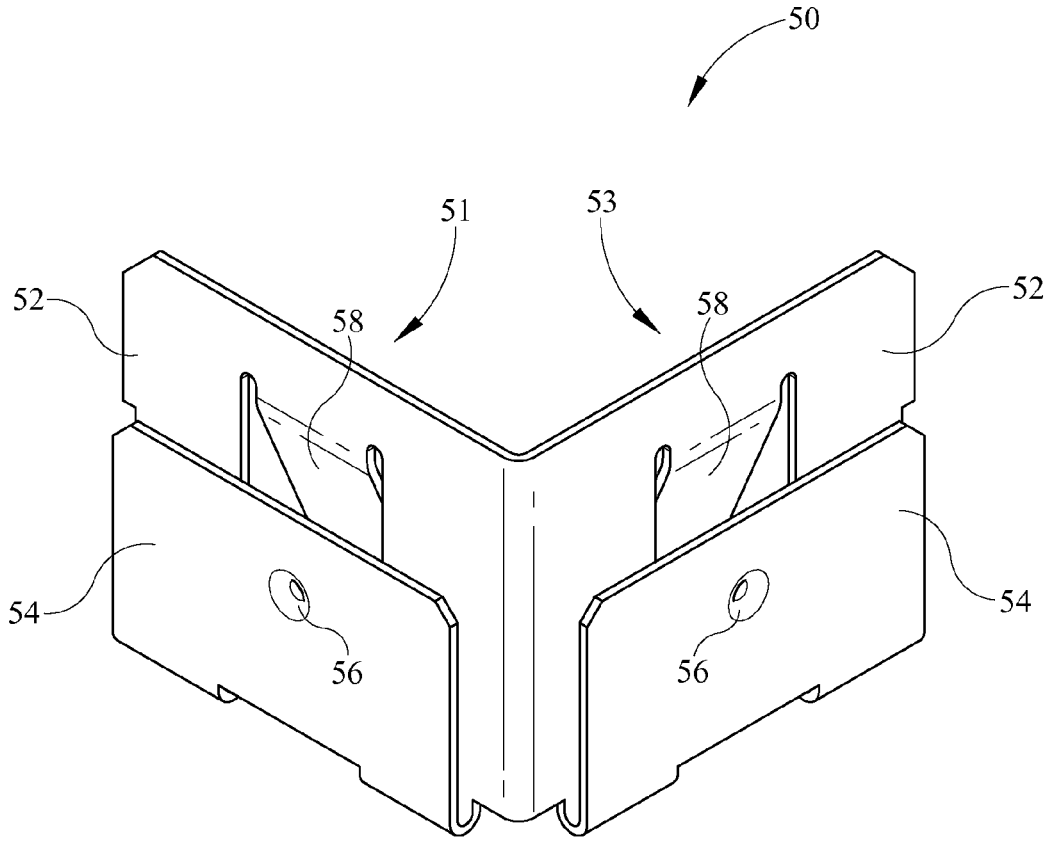
FIG. 5 is a perspective view of a trim spring utilized with the trim assembly of FIG. 1; and, FIG. 6 is an opposite perspective view of the trim spring of FIG. 4.

Referring now to FIG. 5, an active miter spring 50 is depicted in perspective view. The spring 50 is utilized to engage the outer trim 12 and provide a biasing force on the inner trim 30 so as to decrease the widths of the seams 34 as well as the widths of the seams 40 between the flanges 36. The active miter spring 50 comprises a first portion 51 and a second portion 53. The first portion 51 is at an angle of about ninety (90) degrees from the second portion 53. This arcuate distance is utilized because the spring 50 is connected to the outer trim 12 having a square shape with corners of 90 degrees. If alternative polygonal shapes are utilized for the outer trim 12 and the inner trim 30, the angles between the spring portions 51, 53 may be adjusted to compensate for such shape. For example, if an octagonal shape is utilized for the inner and outer trims 30,12, the angle between first and second portions may be about one hundred thirty-five (135) degrees. Alternatively, if a hexagonal shape is utilized for the inner and outer trims 30,12, an angle of one-hundred twenty (120) degrees may be utilized. Various other shapes may be utilized. Each portion 51,53 comprises a first spring wall 52 and an adjacent retaining wall 54. The spring wall 52 and retaining wall 54 define a hem which will be understood by one of skilled in the art to provide a space wherein a lower edge of the outer trim 12 is positioned. Specifically, each active miter spring 50 is located at a corner of the outer trim 12 as depicted in the previous figures. Retaining wall 54 further comprises a dimple 56 which engages a mating recess or aperture 57 (FIG. 2) on each surface of the outer trim side walls 14. Additionally, a fastener may extend through features 56, 57 to retain springs 50 on the outer trim 12. Extending from the spring wall 52 is a kick leg 58. Each kick leg 58 extends inwardly so that when the active miter spring 50 is placed along the lower edge of the outer trim 12, the kick leg 58 will engage an adjacent reflective surface 32 and force the reflector 32 inwardly, thereby reducing seam width between reflectors 32. Since each spring 50 engages two reflectors 32, the two adjacent reflectors 32 are forced toward one another to close seams 34, 40 therebetween.

Figure 6:
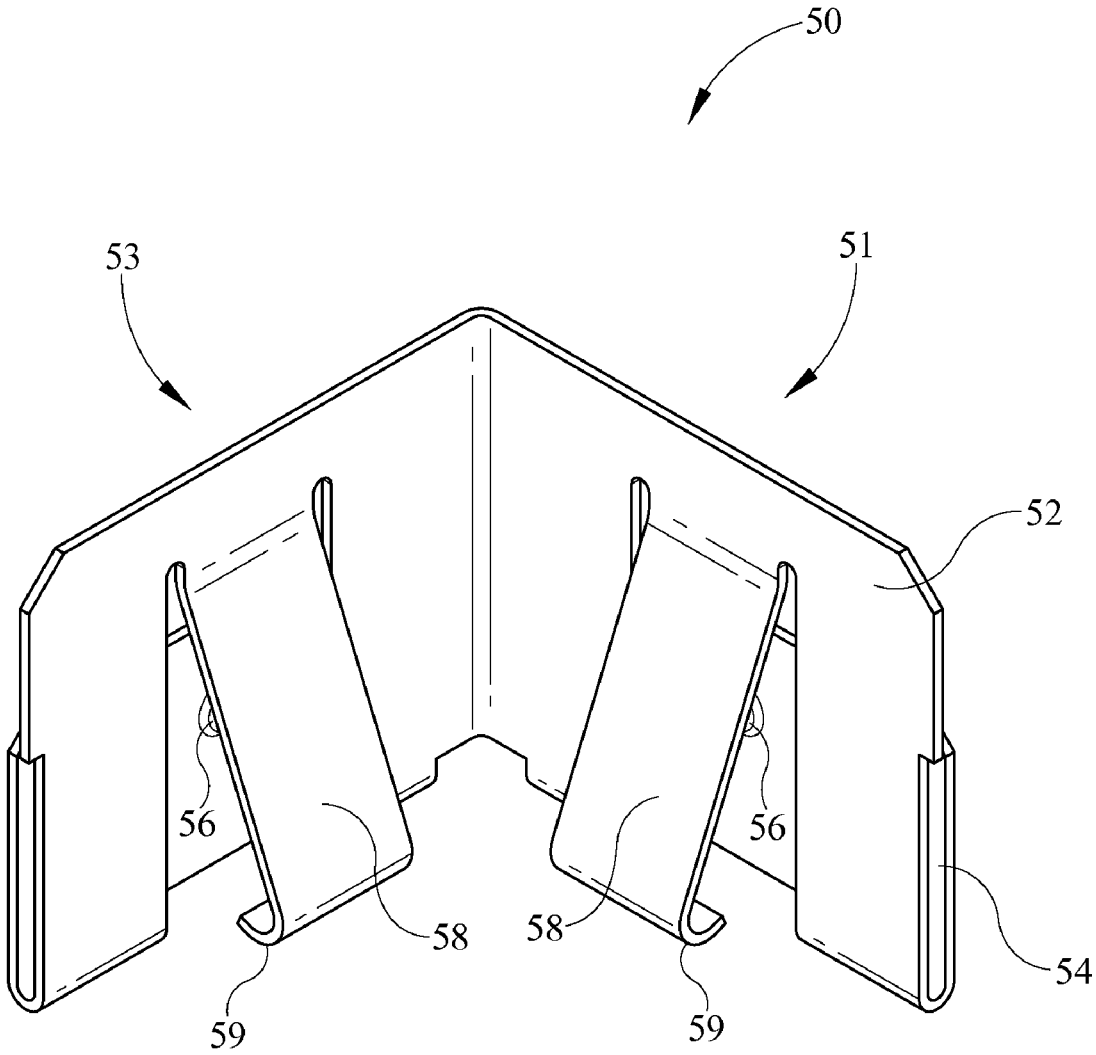

Referring now to FIG. 6, the spring 50 is depicted from the opposite side as depicted in FIG. 4. The hem is generally depicted as U-shaped and connecting the spring wall 52 to the retaining wall 54. The kick leg 58 is stamped and has a rolled end portion 59 so that when the leg 58 engages an adjacent reflective surface 32, the reflector 32 is not damaged by a sharp edge or large point force.

In assembly, the active miter springs 50 are attached to the outer trim 12 at each corner of the lower edge of the outer trim 12. The dimple features 56 are aligned with mating apertures 57 in order to retain the springs 50 in position on the outer trim 12. The outer trim 12 is seated between the spring wall 52 and retaining wall 54 so that the retaining wall 54 is positioned along an outer surface of the outer trim 12. The flanges 36 of inner trim 30 are next fitted with biscuits 44 so that the flanges 36 are aligned within a horizontal plane. Once each corner of the inner trim 30 comprises a biscuit 44, the inner trim 30 is positioned upwardly through the lower opening of the outer trim 12. The reflectors 32 engage the legs 58 as the inner trim 30 is positioned within the outer trim 12. Due to the engagement of the legs 58 and the reflectors 32, the reflectors 32 are forced inwardly to tightly engage one another. This engagement reduces width of the seams 34 between reflectors 32. Likewise, the spring force causes tightening of the seams 40 between the flanges 36. Due to the tightening of theses seams 34, 40, the use of various flange and trim shapes is possible, since seam width and appearance have generally precluded the use of shapes other than circular. Once the inner trim 30 is positioned within the outer trim 12, the fasteners 22 are positioned through the upper wall 20 and the upper flange 38. The fasteners 22 may be a plurality of known fasteners, and in the present embodiment are rivets.

The foregoing description of structures and methods has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A recessed luminaire trim assembly, comprising:

an outer trim;

an inner trim having a polygon shaped cross-section defined by a plurality of adjacent reflectors and a plurality of seams, each of said seams defined between said adjacent reflectors;

a flange extending outwardly from a peripheral edge of said inner trim;

said outer trim substantially surrounding said inner trim and resting on said inner trim flange;

a spring connected to said outer trim, said spring having at least one kick leg engaging said inner trim and tightening said plurality of seams;

wherein said spring engages said outer trim and provides a biasing force on said inner trim so as to decrease the widths of said seams.

2. The trim assembly of claim 1, said inner trim having a generally square shaped cross-section.

3. The trim assembly of claim 1, wherein said at least one kick leg of said spring comprises a first kick leg and a second kick leg for engaging said plurality of reflectors defining said plurality of seams.

4. The trim assembly of claim 3 wherein said spring is located at each of said plurality of seams.

5. The trim assembly of claim 1, said inner trim having four reflectors.

6. The trim assembly of claim 1 said spring having a first portion and a second portion, each of said first and second portion having a kick leg.

7. The trim assembly of claim 6, said spring closing said each of said seams at each of said corner of said flange.

8. The trim assembly of claim 6, said leg extending inwardly from said spring and closing said seams at said reflectors and said flanges.

9. The trim assembly of claim 6 further comprising a biscuit connecting each of said seam at each corner of said flange.

10. The trim assembly of claim 1, said outer trim further comprising a plurality of sidewalls.

11. The trim assembly of claim 10, said spring engaging two sidewalls.

12. A trim assembly, comprising:

an outer trim having a plurality of sidewalls defining a lower opening and an upper opening;

a miter spring disposed at each sidewall of the lower opening of said outer trim and having first and second portions;

at least one kick leg extending inwardly from each portion of said spring;

a plurality of reflectors positioned within said outer trim and combined together forming an inner trim, said inner trim having a lower flange;

an L-shaped biscuit resting in said flange at a joinder of each of said plurality of reflectors, said L-shaped biscuit and said spring tightening each of said joinders;

wherein each of said plurality of reflectors is engaged by said at least one kick leg of said miter spring.

13. The trim assembly of claim 12, said miter spring receiving said outer trim.

14. The trim assembly of claim 13, said at least one kick leg being a first leg and a second leg.

15. The trim assembly of claim 14, said miter spring placing a force on said plurality of reflectors to close seams disposed between said plurality of reflectors at said joinder.

16. The trim assembly of claim 12 further comprising a fastener connecting said plurality of reflectors and said outer trim.

17. The trim assembly of claim 12, said inner trim having a polygon shaped cross-section.

18. The trim assembly of claim 12, said inner trim having a square shaped cross-section.

19. A trim assembly, comprising:

a trim spring having a first and a second portion, each portion having a kick leg;

a plurality of reflectors defining an opening;

a seam located between each of said plurality of reflectors;

said trim spring connected to a first stationary portion of said trim assembly;

said first kick leg of said trim spring engaging a first reflector surface of said plurality of reflectors and said second kick leg of said trim spring engaging an adjacent second reflector surface of said plurality of reflectors;

wherein said seam is minimized due to the force of said first kick leg and said second kick leg on said reflector surface.

* * * * *